US009970168B2

(12) United States Patent
Krause

(10) Patent No.: US 9,970,168 B2
(45) Date of Patent: May 15, 2018

(54) DOG WASTE CLEAN-UP TOOL

(71) Applicant: Blane Alan Krause, Lee's Summit, MO (US)

(72) Inventor: Blane Alan Krause, Lee's Summit, MO (US)

( * ) Notice: Subject to any disclaimer, the term of this patent is extended or adjusted under 35 U.S.C. 154(b) by 237 days.

(21) Appl. No.: 14/692,490

(22) Filed: Apr. 21, 2015

(65) Prior Publication Data

US 2015/0299970 A1 Oct. 22, 2015

Related U.S. Application Data

(60) Provisional application No. 61/982,376, filed on Apr. 22, 2014, provisional application No. 62/032,606, filed on Aug. 3, 2014, provisional application No. 62/101,802, filed on Jan. 9, 2015.

(51) Int. Cl.
*E01H 1/12* (2006.01)

(52) U.S. Cl.
CPC ... *E01H 1/1206* (2013.01); *E01H 2001/1233* (2013.01); *E01H 2001/1266* (2013.01)

(58) Field of Classification Search
CPC ..... E01H 1/1206
See application file for complete search history.

(56) References Cited

U.S. PATENT DOCUMENTS 3,685,088 A 8/1972 Henry
3,740,086 A * 6/1973 Rossitto ..... E01H 1/1206 119/161
3,854,578 A 12/1974 Shame
4,148,510 A 4/1979 Brack
4,273,370 A 6/1981 Kjaer
4,286,816 A * 9/1981 Tobias ..... E01H 1/1206 294/1.4
4,555,132 A * 11/1985 Takoushian ..... A01K 1/0107 294/1.5
4,875,729 A 10/1989 Peck
4,900,077 A 2/1990 Beck
5,054,828 A 10/1991 Hantover
5,064,233 A 11/1991 Sloan
5,186,506 A 2/1993 Gale
5,318,330 A 6/1994 Dombrowski
5,358,295 A 10/1994 Campbell
5,564,763 A 10/1996 Mercurio
6,048,008 A 4/2000 Shaw
6,406,082 B1 6/2002 Telfer
6,745,894 B2 6/2004 Dean
6,986,325 B1 2/2006 Hsu
7,216,905 B1 5/2007 Armes
7,506,615 B1 3/2009 Sansone
8,292,339 B1 10/2012 Auseklis

OTHER PUBLICATIONS

U.S. Appl. No. 13/690,971, filed Jun. 5, 2014, Johannes.
U.S. Appl. No. 14/092,530, filed May 29, 2014, Stoccardo.

* cited by examiner

*Primary Examiner* — Thomas M Sember

(57) ABSTRACT

A dog waste clean-up tool for retrieving solid waste from the ground is disclosed. A reusable canister with interior paper dividing walls is placed onto the dog waste with its opening and dividers facing down. The user presses the canister, and its dividers, into the waste by stepping on the bottom of the canister and placing weight onto the canister until waste adheres to the dividers. The user picks up the canister and places it onto a disposable lid. The soiled paper dividers and the lid are ejected from the canister into a garbage bin or a composting bin.

13 Claims, 12 Drawing Sheets

DOG WASTE CLEAN-UP TOOL

CROSS-REFERENCE TO RELATED APPLICATIONS

This application claims priority to U.S. Provisional Patent Application Ser. No. 61/982,376 filed on Apr. 22, 2014, Application Ser. No. 62/032,606 filed on Aug. 3, 2014, and Application Ser. No. 62/101,802 filed on Jan. 9, 2015.

STATEMENT REGARDING FEDERALLY SPONSORED RESEARCH OR DEVELOPMENT

Not applicable.

TECHNICAL FIELD

The present invention relates generally to a device for picking up dog waste. More specifically, the present invention discloses an earth friendly device that presses a paper lattice material into the dog waste, lifts the waste from the ground, and discreetly stores the waste for transport to a garbage bin or a composting bin.

BACKGROUND

Dog waste is a pollutant and contains harmful bacteria. If not collected responsibly, dog waste kills the nearby vegetation, and the bacteria from the waste can contaminate the groundwater and nearby bodies of water.

Many people do not clean up their dog's waste, especially when walking their dog, largely because the available tools for picking up and transporting the waste are unpleasant to use. The most common approach requires the dog owner to place a plastic bag over their hand and then cradle the dog waste in their hand while picking it up. The warmth and texture of the waste is difficult for most people to become accustomed to, and a tiny hole in the bag can allow a passage way for bacteria.

Dog waste that is disposed within small plastic bags is typically transported to a landfill where it becomes preserved for perhaps hundreds of years. Several cities and waste management companies are currently exploring alternative approaches for eliminating dog waste without transporting it to a landfill. The medium for which the dog waste is collected is an important component to solving this problem.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention are directed to a lifting and temporary storage device for dog waste utilizing a paper lattice material coupled to the interior of a base canister where placement of the device onto a pile of waste with manual pressure adheres the waste to the lattice material. The device for picking up dog waste comprises a reusable shallow canister containing a disposable paper lattice with thin dividers that extend perpendicular from the interior base of the canister and also comprises a disposable paper lid.

A series of cleats protruding along the interior perimeter of the canister wall near the base of the canister secure the paper lattice material to the canister. The cleats support the weight of the lattice material and the dog waste when the open canister is lifted from the ground.

The paper lid covers the opening of the canister and provides a barrier for containing the dog waste during transport. A retaining slot for insertion of the paper lid pinches the skirt of the lid and secures the lid in place. Extraction holes on the base surface of the canister allow easy extraction of the used paper lattice material and the paper lid by pushing a finger through the extraction hole and pushing material out from the cleats.

The device also comprises an optional removable interface bracket which couples a vertical pole handle to the top surface of the canister and allows for pick up of the dog waste without bending over. The vertical pole handle is hollow and contains a sliding vertical rod terminated with a support member that is bonded to an extraction plug at each opposing end. The sliding vertical rod presses the extraction plugs into the canister extraction holes and easily extracts the used paper lattice material.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views.

DETAILED DESCRIPTION

Figure 1:
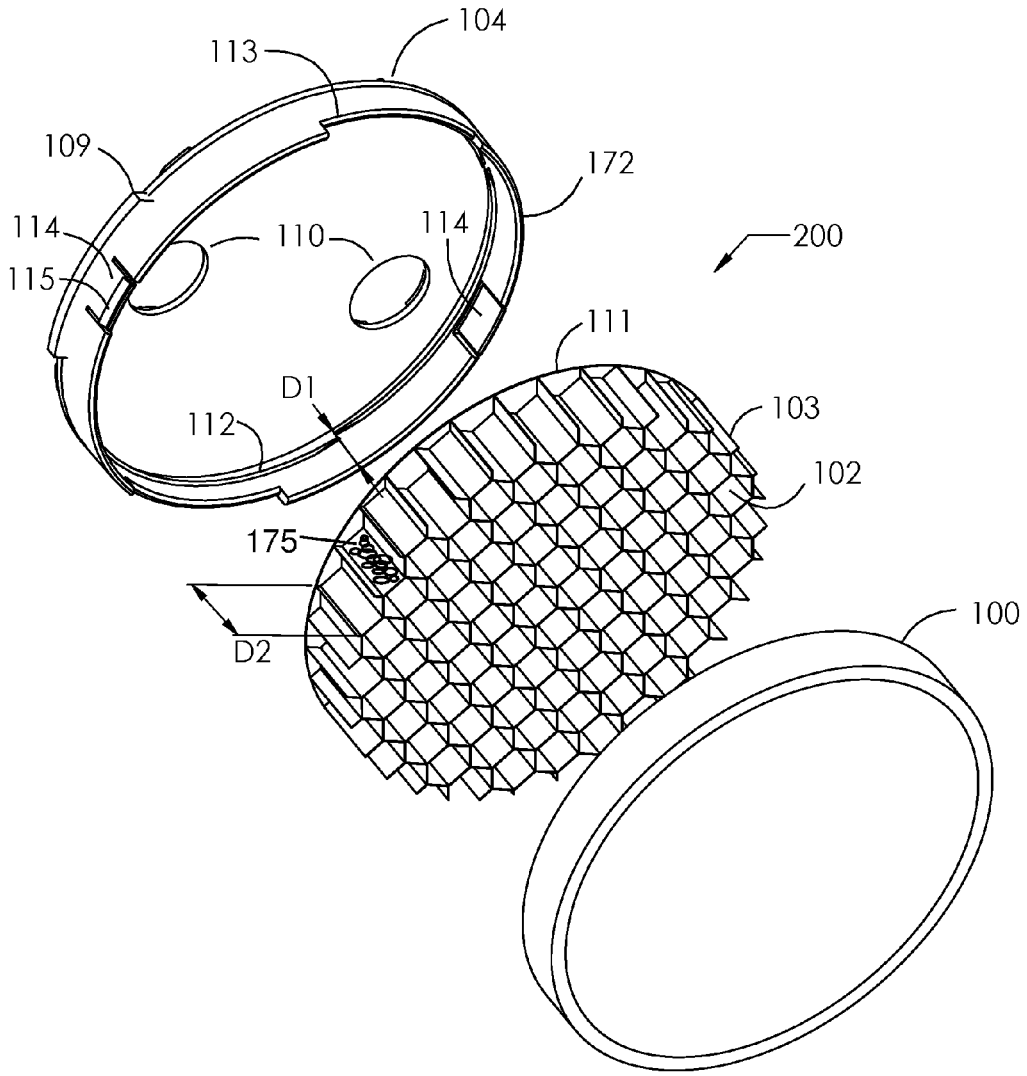
FIG. 1 is an exploded view of an earth friendly dog waste clean-up tool in accordance with an embodiment of the present invention.

With reference to the drawings, wherein like reference characters designate like parts throughout the different views, a lifting and temporary storage device for dog waste is disclosed. More specifically, a device for easy collection and disposal of dog waste is disclosed where the device is pressed onto the pile of waste with the user's foot, and the waste becomes lodged into a paper lattice material. Through this mechanism, the collecting of dog waste is more appealing, and the disposable medium for transporting the waste is biodegradable and earth-friendly.

Referring initially to FIG. 1, a lifting and temporary storage device for dog waste 200 in accordance with an embodiment of the present invention is depicted. The device 200 comprises a shallow canister 104, a waste capture material 103, and a disposable paper lid 100. The shallow canister 104 can be manufactured in any shape but is depicted here as a cylindrical shape.

The interior of the waste capture material 103 has multiple dividing walls 102 that separate the waste capture material 103 into multiple independent chambers. As shown in FIG. 1, the waste capture material 103 can be in the format of a honeycomb paper material that is a common packaging material in the shipping industry. The waste capture material or honeycomb paper lattice 103 has only one side of kraft paper 111 glued to the honeycomb edges. The single sided honeycomb is die cut to the inner dimensions of the canister 104 such that it has a snug fit when pressed into the canister 104.

The canister 104 has single threads 112 on its inner cylinder walls so that the kraft paper 111 is held in place under the threads 112 when the honeycomb paper lattice 103 is rotated and pressed underneath the threads 112. The threads 112 and snug fit of the honeycomb 103 provide enough resistance to uphold the weight of the dog waste when the canister 104 is lifted from the ground.

The threads 112 can also be replaced with short segments of thread or protruding cleats evenly spaced around the inner circumference of the canister 104. The kraft paper 111 provides a barrier between the canister 104 and the waste so that the canister 104 is not soiled during waste retrieval.

To retrieve dog waste, the canister 104 is placed with the canister opening 172 and the dividing walls 102 facing down toward the waste. With the canister 104 resting and centered on the waste, the user places one foot onto the outside surface of the canister 104 and presses much of their weight onto the canister 104. This drives the waste up into the paper honeycomb lattice 103 and divides the waste into multiple sections. Each section of waste adheres to the side walls 102 of each independent chamber and becomes difficult to remove. This process is similar to stepping in dog waste with treads of a shoe; however, the waste canister 104 has much deeper chambers in lieu of treads, and the waste canister 104 completely isolates the user's shoe from the waste.

Figure 2:
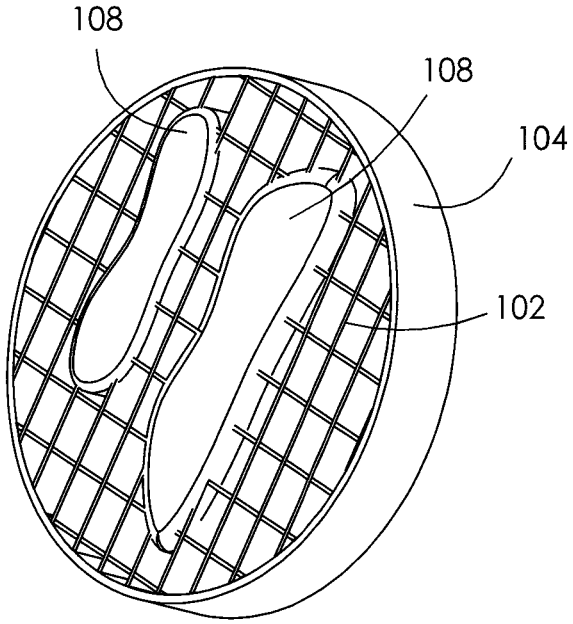
FIG. 2 is a perspective view of the earth friendly dog waste clean-up tool with dog waste adhering to the interior of the tool in accordance with an embodiment of the present invention.

Once the canister 104 is pressed fully to the ground, and the waste is fully hidden, the canister 104 can easily be picked up without contacting the waste. As shown in FIG. 2, the waste 108 will be imprinted into the divider walls 102 and little if any of the waste 108 will fall from the canister 104 when lifted from the ground. FIG. 2 depicts a disposable paper canister with an integral paper lattice.

After picking up the canister 104, the user discreetly sets the canister 104 onto the lid 100 and presses the lid 100 over the opening. The inside diameter of the lid 100 has only a slightly larger diameter than the canister 104 so that it has a snug fit, and the lid 100 seals most of the odor within the canister 104.

The total surface area of the walls 102 within an individual divided chamber is much greater than the contact surface area of the waste 108 to the ground surface. This results in the waste 108 adhering more strongly to the individual chamber walls 102 in lieu of the ground surface. In most instances when walking a dog, the waste 108 will be deposited on grass, dirt, or sand which all have less adhesive capability. To further increase the adhesion on the divided chamber walls 102, the dividers 102 can be manufactured with a rough surface finish.

The depth D1 of the canister 104 in FIG. 1 is manufactured to be slightly less than the depth D2 of the honeycomb paper lattice 103. This allows the honeycomb lattice 103 to make full contact with the ground surface when the user places weight on top of the canister 104 and also allows the honeycomb lattice 103 to conform slightly to bumps or elevated ground surfaces.

For large dogs or for scattered piles, the honeycomb edges 103 can be used to brush the waste 108 into a condensed pile prior to placing the canister 104 onto the pile. A notched edge 113 of the canister 104 provides exposed honeycomb lattice 103 that can be used for the brushing motion. Separated piles that cannot be picked up with one placement of the canister 104 can be pressed into the honeycomb lattice 103 with a second placement and stepping motion.

Due to different expansion characteristics of dissimilar materials in varying temperatures, the diameter of the canister 104 may expand and contract more significantly than the inside diameter of the paper lid 100. If the canister 104 is manufactured from a pliable material such as plastic, flexible tabs 114 can be added to hold the paper lid 100 in place in all temperature extremes. After waste retrieval, the lid 100 is placed on the canister 104, and the flexible tabs 114 with raised wedges 115 provide a clasp that grabs inside skirt of the paper lid 100 to hold the lid 100 in place.

Figure 3:
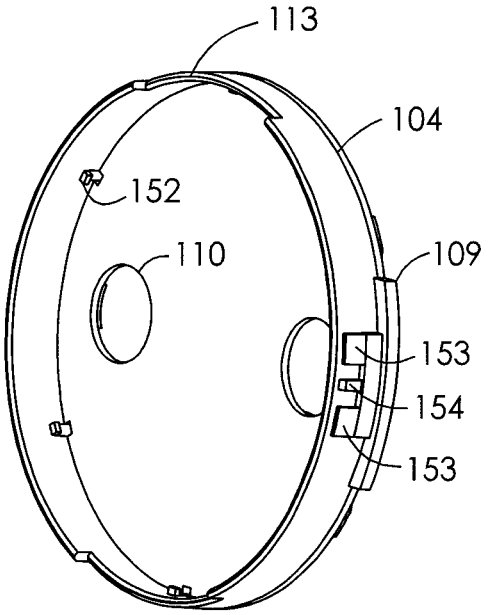
FIG. 3 is a perspective view of a reusable shallow canister with an alternate clasping mechanism for a paper lattice interior and for a paper lid in accordance with an alternate embodiment of the present invention.

The canister 104 as shown in FIG. 3 depicts an alternate design for securing the paper lid 100 after the waste 108 is retrieved. A pair of teeth 153 protrude from the bottom of a handle 109 toward the cardboard lid 100 and are arched at the same radius as the surface of the canister wall 104. A gap between the teeth 153 and the surface of the canister 104 is just wide enough to slide the skirt of the lid 100 behind the teeth 153. A lifting wedge 154 is affixed to the surface of the canister 104 and pushes the skirt of the lid 100 out toward the teeth 153 as the lid 100 is pushed onto the canister 104. This pinches the skirt of the lid 100 between the wedge 154 and the pair of teeth 153 and tightens any slack between the outer edge of the canister 104 and the skirt of the lid 100.

A second set of the teeth 153 with the wedge 154 are affixed on the opposite side of the canister 104 so that the lid 100 is pinched at two points. The canister 104 as depicted in FIG. 3 has also replaced the threads 112 with protruding cleats 152 that are equally spaced around the inner circumference of the canister 104.

A hole 110 is located in the canister 104 near each of the handles 109. The holes 110 in conjunction with the handles 109 are used to easily extract the used honeycomb lattice 103 and the used lid 100 from the canister 104 as one assembly. With fingers cradled under each of the handles 109, the user can project a thumb, or other object, through the extraction hole 110 on each side of the canister 104 and gently push out the used honeycomb lattice 103 and the used lid 100 while isolated from the waste 108 by the kraft paper 111.

Figure 4:
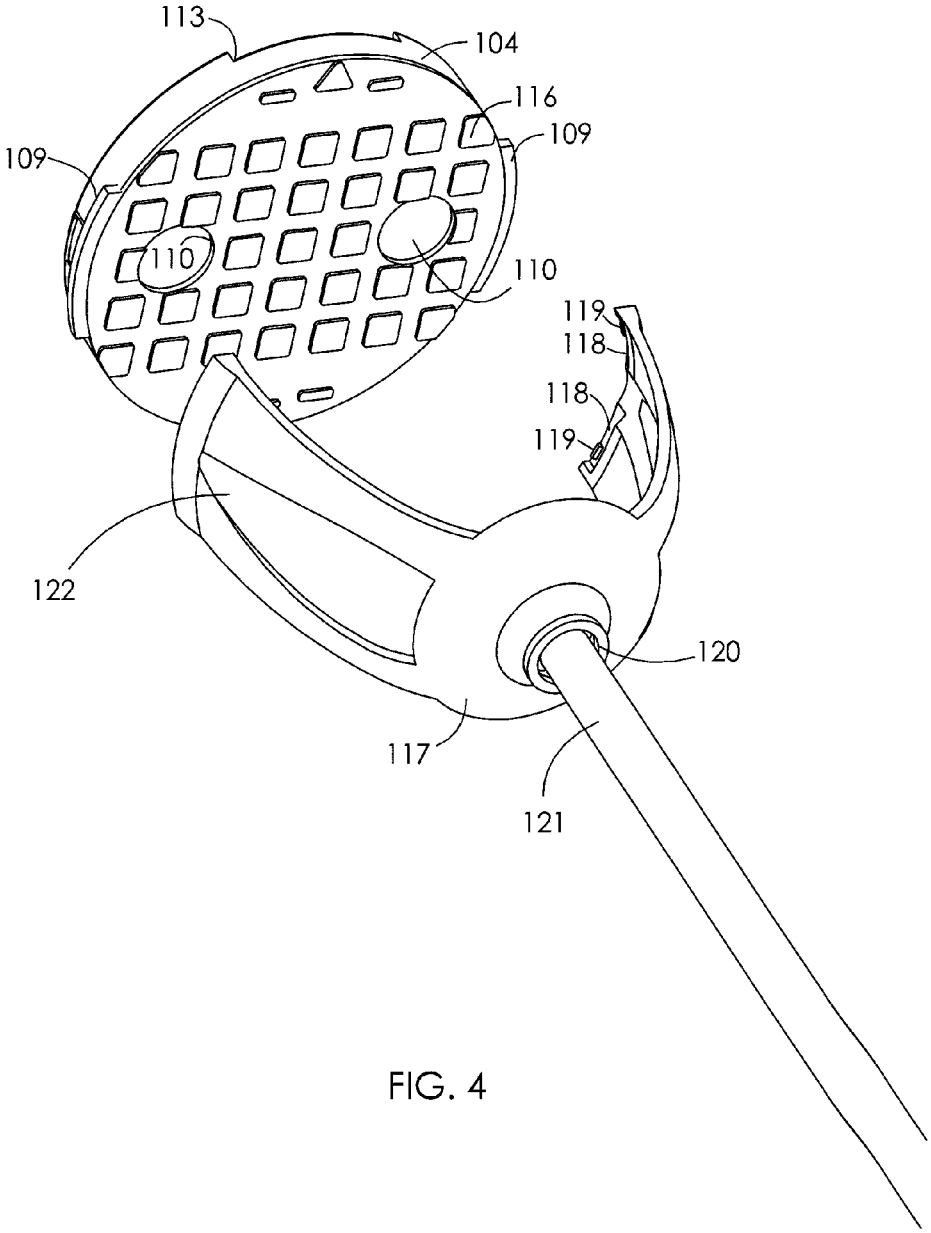
FIG. 4 is a partial perspective view of a vertical attachment pole handle of the dog waste clean-up tool in accordance with an embodiment of the present invention.

The waste clean-up tool 200 can also have a multi-use application, such as at home each time the dog leaves its waste in the yard. In this application, the lid 100 is not needed because the used honeycomb lattice 103 is immediately removed and discarded. A pole handle 121, as shown in FIG. 4, can be added to the canister 104 so that the dog owner does not need to bend over to retrieve the waste 108.

An interface bracket 117 snaps onto the top of the canister 104 and provides for connection of the vertical pole handle 121. One such shape for the interface bracket 117 is a cone shape such as that shown in FIGS. 4 and 5. The handles 109 of the canister 104 connect to snaps 119 and into voided areas 118 on each side of the interface bracket 117. The pole handle 121 screws into a threaded hole 120 of the interface bracket 117. The interface bracket 117 is of sufficient size for the user to insert a shoe through the bracket 117. When retrieving waste, the user places their foot through the interface bracket 117 and steps onto the canister 104.

After pressing the storage device onto the waste, the pole handle 121 can be used to carry the used honeycomb lattice 103 to the garbage can or a drying location. An access hole 122 on each side of the bracket 117 allows the user to access the extraction holes 110 on the canister 104 for easy removal of the used honeycomb lattice 103.

Figure 5:
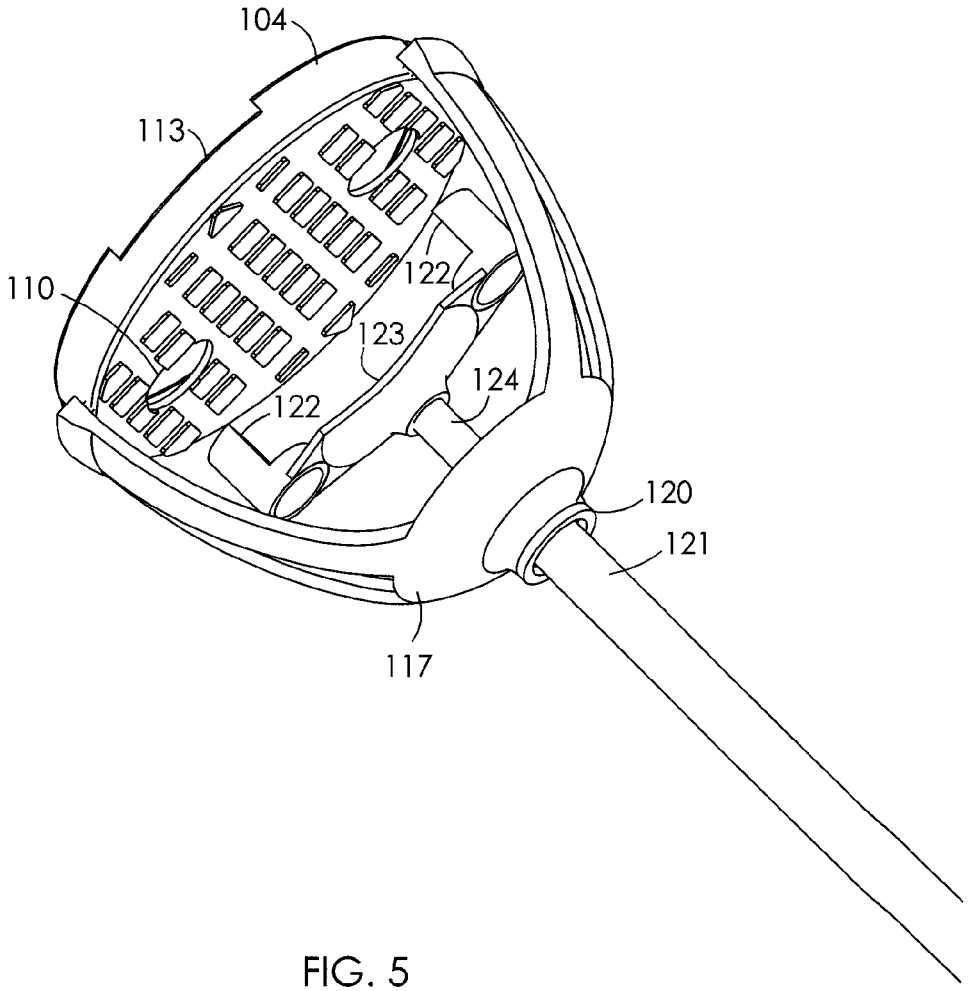
FIG. 5 is a partial perspective view of the vertical attachment pole handle with a sliding ejection mechanism in accordance with an embodiment of the present invention.

An additional accessory for quick removal of the honeycomb lattice 103 can be added to the vertical handle 121 as shown in FIG. 5. In this embodiment, the vertical handle 121 is hollowed out and a rod 124 is inserted into the handle 121 and freely slides up and down within the hollow handle 121. The rod 124 is terminated with a support member 123 that has a cylindrical plug 122 attached at each of its opposing ends.

The cylindrical plugs 122 are sized slightly smaller than the diameter of the extraction holes 110. When the rod 124 is pushed down toward the canister 104, the cylindrical plugs 122 poke through the extraction holes 110 and push the used honeycomb lattice 103 out of the canister 104.

When not in use, the support member 123 and the plugs 122 are lifted to the top of the bracket 117 with the sliding rod 124 and snap into an upright locked position. Once locked into the upright position, the support member 123 and the plugs 122 provide clearance for the user to place their foot through the bracket 117.

Figure 6:
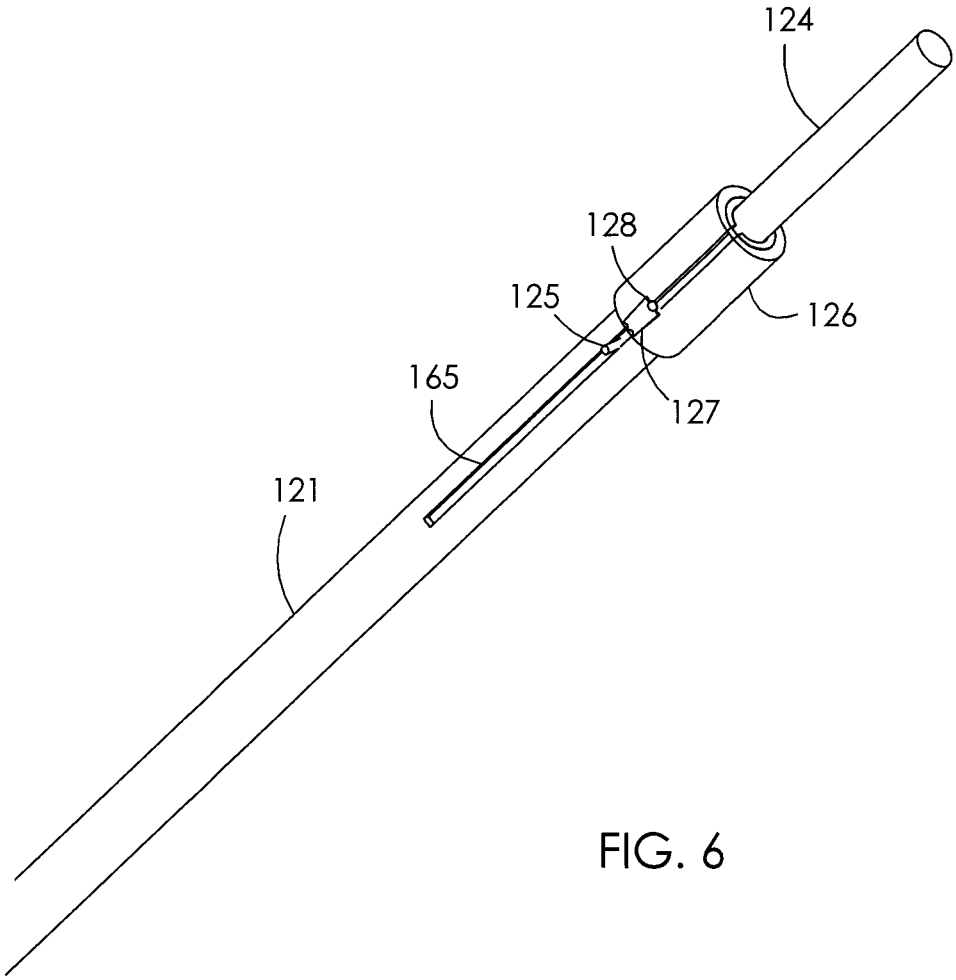
FIG. 6 is a perspective view of the vertical attachment pole handle with a sliding interior rod in accordance with an embodiment of the present invention.

The hollowed handle 121 is slotted at its top end as shown in FIG. 6 to prevent the rod 124, the support member 123, and the plugs 122 from freely spinning. The rod 124 has a fixed pin 125 that protrudes out on one side of the rod 124 and through a slot 165. The pin 125 slides freely up and down in the slot 165 as the rod 124 travels within the hollow handle 121.

To lock the rod 124 in the upright position, the pin 125 engages into a latching collar 126 at the top of the hollow handle 121. The latching collar 126 is a thin flexible plastic that has a slight oval shape, and its top opening is affixed or plastic welded to the hollow handle 121.

The widest diameter of the oval shaped collar 126 is perpendicular to the axis of the pin 125, and the narrowest diameter of the oval shaped collar 126 is parallel to the axis of the pin 125. A void between the hollow handle 121 and the interior of the oval shaped collar 126 that results due to the oval shape of the collar 126 allows the oval shaped collar 126 to be compressed by hand in the direction perpendicular to the axis of the pin 125.

A wedge 127, embedded into the plastic oval shaped collar 126, provides a ramp for the pin 125 as the solid rod 124 is slid upward and the pin 125 enters the oval shaped collar 126. As the wedge 127 rides the surface of the pin 125, the collar 126 is pushed out and the oval collar 126 temporarily becomes a circular shape. When the pin 125 reaches a hole 128, the collar 126 snaps back into its natural oval shape, and the solid rod 124 is latched into an upright position.

When the oval collar 126 is manually compressed in a direction perpendicular to the axis of the pin 125, the collar 126 becomes a circular shape again, releasing the pin 125 from the hole 128, and the solid rod 124 can be slid in the downward direction. The manual compression is applied by the user while cradling the oval collar 126 in the hand and squeezing in the direction perpendicular to the axis of the pin 125. The user compresses the collar 126 to release the latch when it is time to eject the used honeycomb lattice 103 from the canister 104 with the support member 123 and the plugs 122.

Figure 7:
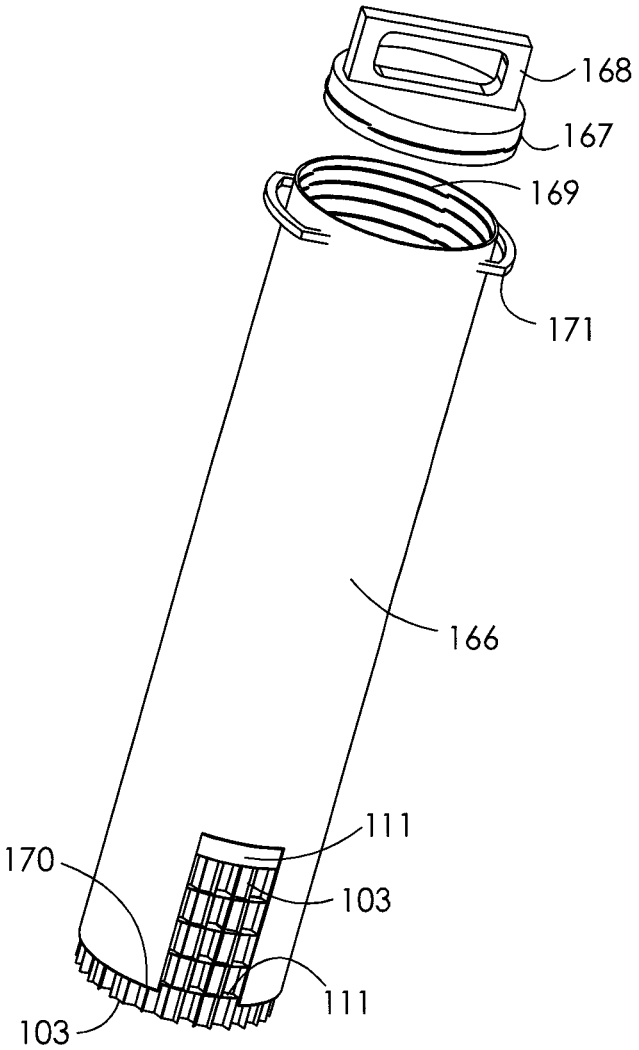
FIG. 7 is a perspective view of an alternate dog waste clean-up tool with a stack of replacement paper lattice cartridges in accordance with an alternate embodiment of the present invention.

An alternate design for the dog waste clean-up tool for use at home is depicted in FIG. 7. This design replaces the shallow canister 104 and the pole handle 121 within a tall canister 166. The tall canister 166 has an inner diameter that is slightly wider than the honeycomb lattice 103 and has course interior threads 169 through its full length. The tall canister 166 is filled with a stack of honeycomb lattice cartridges 103 and has a threaded piston 167 with a handle 168 that can be screwed through the entire length of the tall canister 166.

The bottom edge of the tall canister 166 has a series of cleats 170 protruding along the interior perimeter of the canister 166. The cleats 170 clasp onto the kraft paper 111 glued to the top of the honeycomb lattice 103 and retains the stack of honeycomb cartridges 103 within the tall canister 166. The honeycomb lattice 103 at the bottom of the stack extends beyond the end of the tall canister 166, and the piston 167 is screwed down onto the top honeycomb lattice 103 at the top of the stack.

To utilize the alternate dog waste clean-up tool of FIG. 7, the user places the bottom honeycomb lattice 103 onto the pile of dog waste, holds the tall canister 166 in a vertical position, and presses down on a handle 171 on each side of the canister 166. After the dog waste is lodged into the honeycomb lattice 103, the tall canister 166 can be carried to a garbage bin for disposal.

The soiled honeycomb lattice 103 can be easily dislodged by rotating the handle 168 which drives the piston 167 toward the opening of the canister 166. The bottom honeycomb lattice 103 is pushed out past the cleats 170 and is immediately replaced with the next clean honeycomb lattice 103 in the stack. If the interior diameter of the canister 166 is not wide enough for the user to reach the handle 168, an extension rod can be added to extend the handle beyond the length of the canister 166.

Figure 8:
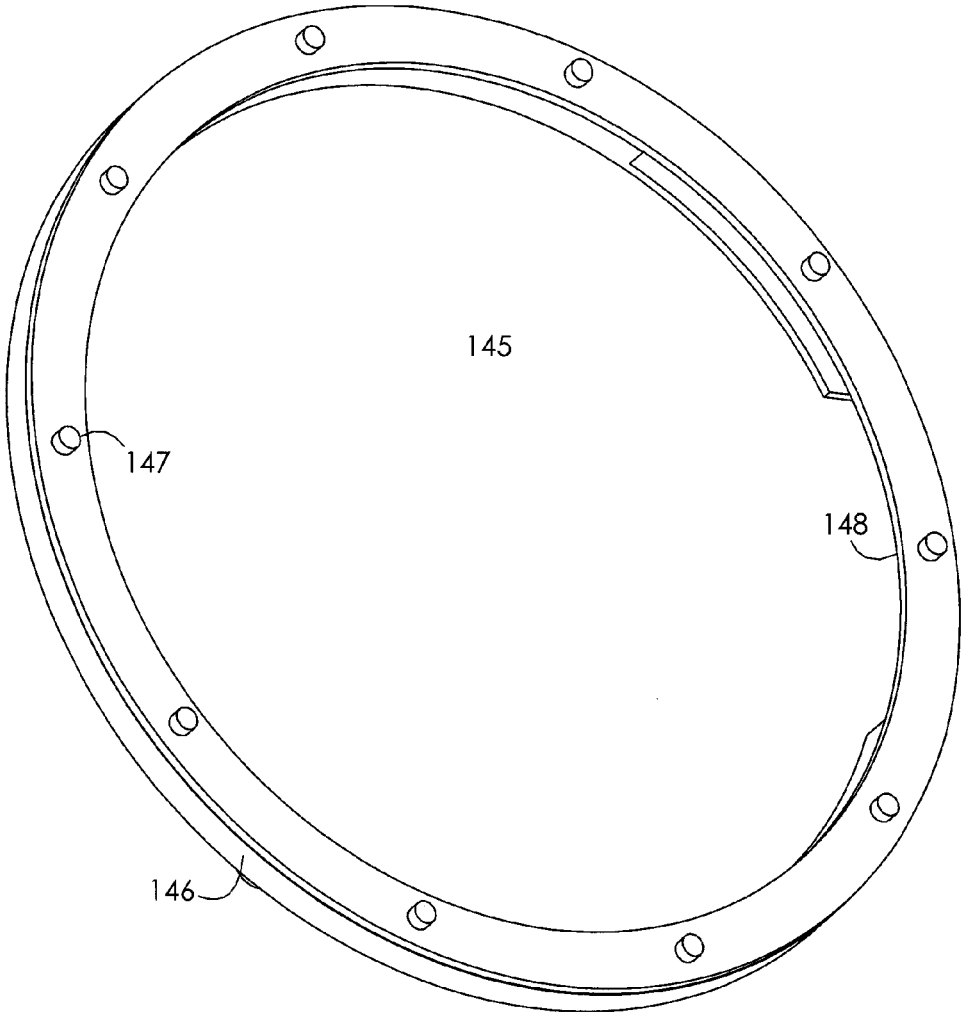
FIG. 8 is a perspective view of a lighted accessory ring for use with a dog waste cleanup tool in accordance with an embodiment of the present invention.

For dog waste clean-up at night or early morning when light is limited, a lighting accessory 145 for the dog waste clean-up tool is presented in FIG. 8. A ring 146 that has an inner diameter slightly larger than the canister 104 has a series of small lights 147 distributed around the circumference of the bottom surface of the ring 146. In one such embodiment, the series of small lights can comprise a plurality of LED's evenly spaced about the ring 146. The ring 146 mates with the outer edge of the canister 104 and is secured at the handles 109 of the canister 104 with the lights facing down toward the ground.

Figure 9:
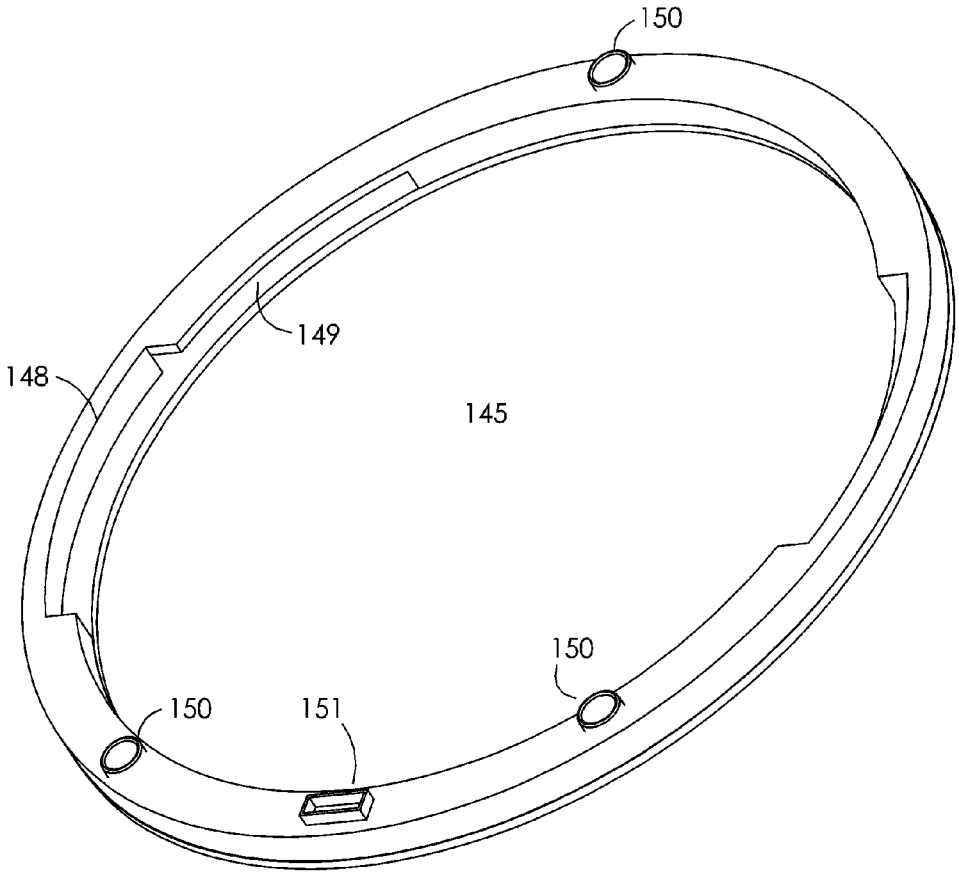
FIG. 9 is a top perspective view of the lighted accessory ring of FIG. 8 in accordance with an embodiment of the present invention.

FIG. 9 is a top perspective view of the ring 146 and shows where a notched void 148 receives the handles 109 of the canister 104. A twisting motion seats the handles 109 into a slot 149. Power to the small lights 147 is provided by several watch sized batteries housed within the ring 146 and is switched by a mini slide switch that is also housed within the ring 146. A rechargeable battery can be permanently housed within the ring 146 in lieu of disposable batteries. The rechargeable battery can be charged through a USB port 151 or equivalent power jack.

Snap buttons 150 on the top surface of the narrow ring 146 as indicated in FIG. 9 are provided for securing the canister 104 to a flexible harness that has mating snap buttons. When walking a dog, the harness can be used to strap the waste clean-up tool 200 around the dog as lightweight cargo. Three or more of the snap buttons 150 provide a means of stabilizing the canister 104 on the harness below the dog's neck, under its body, or on a shoulder. The harness is only used on large dogs that have the strength to tote the weight of the clean-up tool 200.

Carrying the concealed waste 108 within the rigid canister 104 covered with the lid 100 is discreet and more appealing than a bag full of waste. The canister 104 can be manufactured with low cost, lightweight plastic or other solid reusable material. The disposable honeycomb lattice 103 and the lid 100 can be manufactured from low cost biodegradable material such as fabricated rigid cardboard, paper, or recycled molded pulp. The used honeycomb lattice 103 and the lid 100 can be placed into a large re-sealable garbage bag or directly into a garbage bin or compost bin.

The divider walls 102 can be spaced or arranged in varying configurations other than square or hexagon shaped. The dividers 102 can form chambers that are circular, triangular, or shaped like other polygons. The divider walls 102 and the lid 100 can be coated or saturated with a de-odorizing chemical which eliminates or reduces the odor from the dog waste.

Figure 10A:
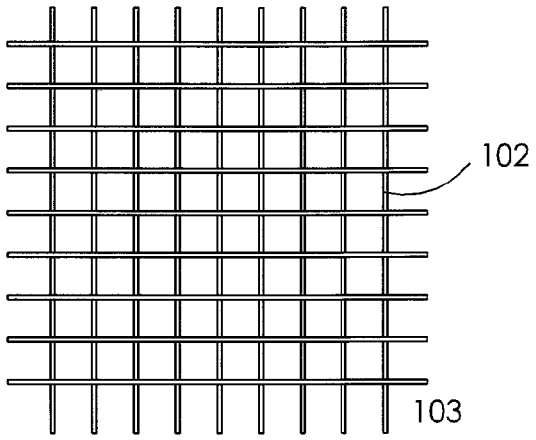
FIG. 10A is a top elevation view of an alternate paper lattice material in accordance with an alternate embodiment of the present invention.
Figure 10B:
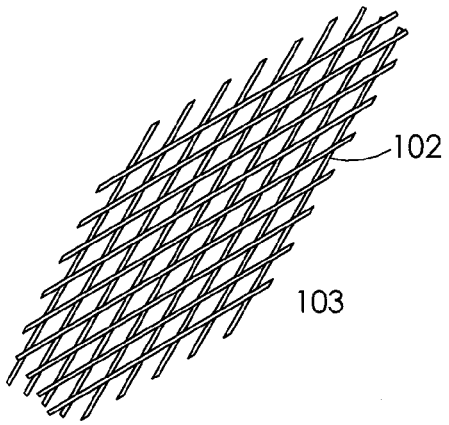
FIG. 10B is a top elevation view of the alternate paper lattice material slightly compressed in accordance with an alternate embodiment of the present invention.
Figure 10C:
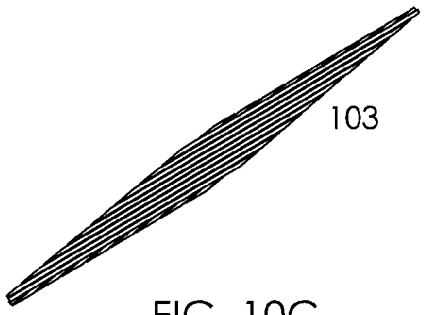
FIG. 10C is a top elevation view of the alternate paper lattice material of FIG. 10B fully compressed in accordance with an alternate embodiment of the present invention.

The paper lattice material 103 as described has one side of kraft paper 111 glued to the honeycomb edges. As depicted in FIG. 10A, the lattice material 103 can be manufactured to be more portable by eliminating the glued kraft paper 111. This allows the paper lattice 103 to be compressed in the lateral direction as depicted in FIG. 10B and FIG. 10C. FIG. 10B shows an intermediate step to fully compressing the lattice to the state depicted in FIG. 10C. Once fully pressed into a strip of material, the paper lattice 103 can be tucked into the user's pocket for portable transport. The folded strip of lattice material 103 can be uncompressed to re-establish its original shape, and the rigidity of the lattice structure can be pressed onto the dog waste 108 without the canister 104. The soiled paper lattice 103 is lifted at its edges, and the dog waste 108 is lifted from ground.

Without the canister 104, the soiled paper lattice 103 can be placed in a bag for disposal. This application for the paper lattice 103 would be most useful for very large dogs in which case a wider canister 104 would be bulky or difficult to transport while on a walk. The shape of the paper lattice in FIG. 10A replicates small cardboard box dividers typically used for storage of glass test tubes in a chemistry lab. The shape and structure of the cardboard box dividers is an alternate format for the paper lattice material.

Figure 11:
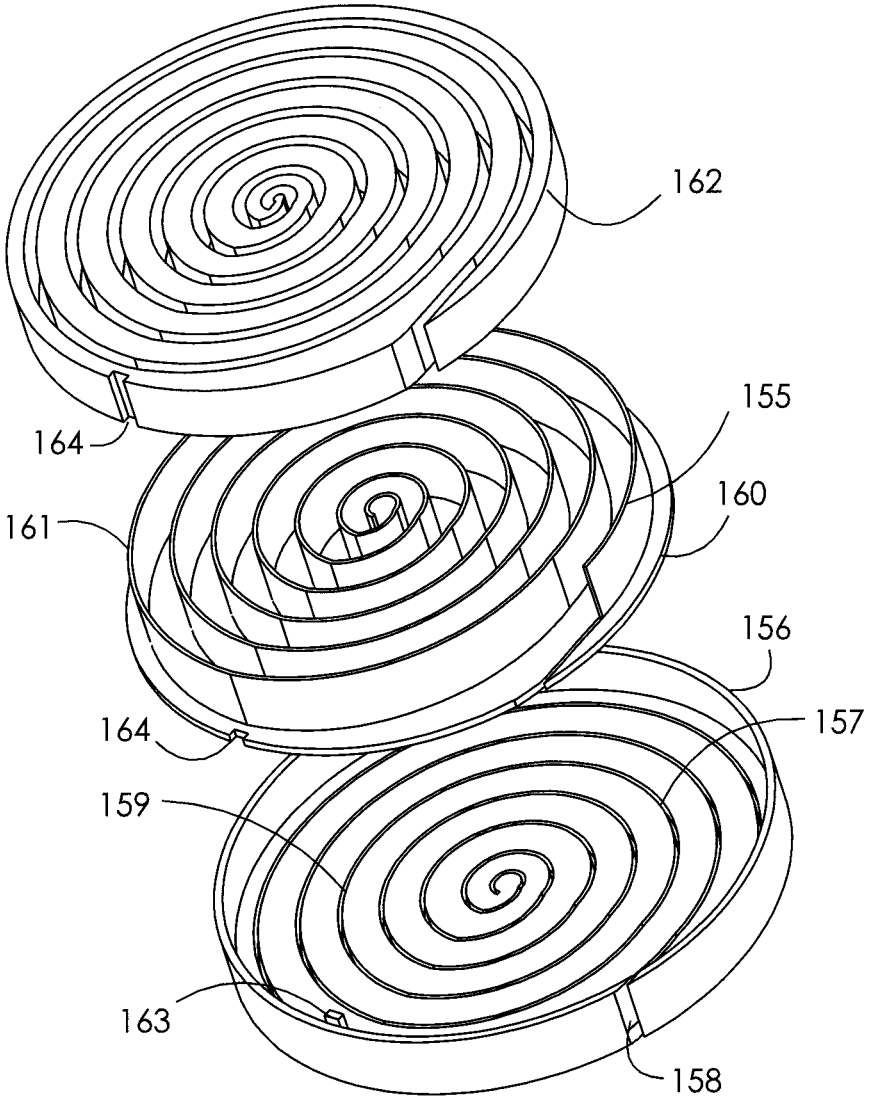
FIG. 11 is a perspective view of a spiral shaped paper material and a shallow canister in accordance with an alternate embodiment of the present invention.

FIG. 11 shows an alternate design for the dog waste clean-up tool which forms an alternate paper lifting material by winding a narrow strip of thin cardboard 155 into a spiral pattern. An alternate shallow canister 156 has a slot 157 cut into its base that forms a spiral shaped guide 159 for the narrow strip of cardboard 155.

A cardboard disc 160 has a die cut pattern to match the spiral shaped guide 159 and is placed into the alternate shallow canister 156 prior to winding the narrow strip of thin cardboard 155. The cardboard disc 160 provides a barrier similar to that of the glued kraft paper 111.

Figure 12:
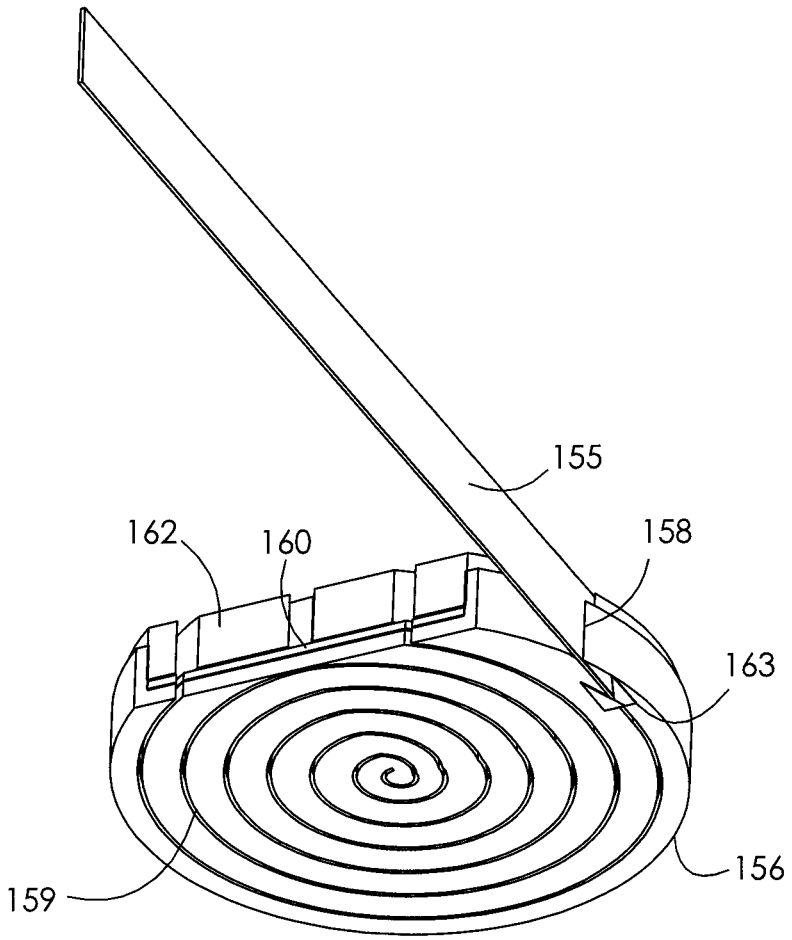
FIG. 12 is a perspective cutaway view of the shallow canister with the spiral shaped paper material being formed in accordance with an alternate embodiment of the present invention.

To form a cardboard winding 161, a deep spiral shaped guide 162 is first affixed to a wall or table. The cardboard disc 160 is placed within the alternate shallow canister 156 while aligning a key pin 163 with a key slot 164, and the shallow canister 156 is then placed over the deep spiral shaped guide 162 while aligning the key pin 163 with the key slot 164. FIG. 12 is a cutaway view that depicts the alternate shallow canister 156 aligned and stacked onto the cardboard disc 160 and the deep spiral guide 162.

Rather than placing the honeycomb cartridge 103 into the canister 156, the user threads the cardboard strip 155 into access opening 158 and pushes the cardboard strip 155 through the full length of the spiral shaped guide 159 and the deep spiral guide 162. In order to keep the cardboard strip 155 aligned with edges parallel to the surface of the alternate canister 156, the edge of the cardboard strip must be held against the wall or table while being fed into the spiral guides 159 and 162.

A V-shape cutting blade 163 can be added near the access opening 158 so that the cardboard strip 155 can be cut to the proper width from a wide sheet of cardboard as the strip 155 is pushed into the spiral guides 159 and 162. This process will require that the excess cardboard sheet is pulled across the V-shape cutting blade 163 from behind the blade 163 with one hand while the user also pushes the strip 155 into the access opening 158 with the other hand.

The width of the slot 157 is slightly narrower than the thickness of the cardboard strip 155; therefore, the slot 157 compresses the edge of the cardboard strip 155 as it slides into the slot 157. The compression of the cardboard strip 155 holds the cardboard strip 155 in place and coupled to the canister 156. After the winding 161 is formed, the assembly can be removed from the deep spiral guide 162. The winding 161 coupled to the canister 156 supports the weight of the dog waste 108 when the canister 156 is lifted from the ground. The dog waste 108 is pressed into channels formed from the cardboard strip 155 and adheres to the walls of the cardboard strip 155.

The alternate design for the dog waste clean-up tool depicted in FIG. 11 provides a less costly paper divider material for the dog owner, as the thin cardboard strip 155 can be formed with material from a disposed cardboard box or from flat poster board that is commonly available in arts and crafts stores.

The waste clean-up tool 200 can be scaled in width and depth proportionally to the size of the dog and can be offered in multiple sizes. Even further, the waste clean-up tool 200 could be scaled up to accommodate larger animals such as a horse. This scale of waste clean-up tool 200 could be utilized during a parade or while showing animals at a fair to discreetly retrieve waste in lieu of scooping it up with a shovel.

The present invention has been described in relation to particular embodiments, which are intended in all respects to be illustrative rather than restrictive. Alternative embodiments will become apparent to those of ordinary skill in the art to which the present invention pertains without departing from its scope. Substitutions may be made and equivalents employed herein without departing from the scope of the invention as recited in the claims. It will be understood that certain features and subcombinations are of utility and may be employed without reference to other features and subcombinations. This is contemplated and within the scope of the claims.

The invention claimed is:

1. A dog waste lifting and temporary storage device comprising:

an upper open-ended canister of less than 2 inch depth;

an upper waste capture material positioned within the canister, the waste capture material having multiple thin walls; and, a lower lid sized to encompass the open-ended canister;

wherein the waste capture material is coupled to the open-ended canister such that upon placement of the canister onto the dog waste and application of a force to the canister, the dog waste adheres to independent chambers of the waste capture material, thereby becoming one assembly that can be lifted and lowered onto the lid.

2. The device of claim 1, wherein the open-ended canister is a tall canister having a stack of replacement honeycomb lattice cartridges and a moveable piston which extracts and replaces a used honeycomb cartridge.

3. The device of claim 1, wherein the waste capture material comprises a paper lattice structure having a plurality of independent chambers and having a paper ceiling to capture and isolate the dog waste.

4. The device of claim 3, wherein the waste capture material and the lid are extracted from the open-ended canister for disposal by pressing against exterior surface of the paper ceiling.

5. The device of claim 3, wherein the paper lattice material lifts the dog waste with forced placement onto the waste without the open-ended canister and without the lid, and the paper ceiling isolates the dog waste from making contact with the user.

6. The device of claim 3, wherein the paper lattice structure is compressible into a flat strip from its original form.

7. The device of claim 3, wherein the independent chambers of the lattice structure have a generally polygon, triangular, elliptical, or circular cross-sectional shape.

8. The device of claim 1, wherein the waste capture material and the lid are impregnated with a de-odorizing chemical.

9. The device of claim 1, further comprising a pinching mechanism affixed to a wall of the canister which pinches a lid skirt between a wedge and a pair of teeth.

10. The device of claim 1, further comprising a notched area at an open edge of the canister which exposes the waste capture material for brushing the waste onto a pile.

11. The device of claim 1, wherein the waste capture material comprises a spiral wound flat, rigid paper material forming one continuous channel.

12. The device of claim 11, wherein the spiral wound rigid material is manually formed by an end user by winding a strip of the material through a spiral shaped guide cut into the canister.

13. The device of claim 12, wherein the strip of the material is cut by the end user from a sheet of material as the sheet of material is fed into the spiral shaped guide by the end user.

* * * * *